US011220950B2

(12) United States Patent
Perfetto et al.

(10) Patent No.: US 11,220,950 B2
(45) Date of Patent: Jan. 11, 2022

(54) ENGINE COOLING SYSTEM AND METHOD FOR A SPARK IGNITED ENGINE

(71) Applicant: Cummins Inc., Columbus, IN (US)

(72) Inventors: Anthony Kyle Perfetto, Columbus, IN (US); Samuel C. Geckler, Columbus, IN (US)

(73) Assignee: Cummins Inc., Columbus, IN (US)

( * ) Notice: Subject to any disclaimer, the term of this patent is extended or adjusted under 35 U.S.C. 154(b) by 113 days.

(21) Appl. No.: 16/665,292

(22) Filed: Oct. 28, 2019

(65) Prior Publication Data

US 2020/0056532 A1 Feb. 20, 2020

Related U.S. Application Data

(63) Continuation of application No. PCT/US2018/033673, filed on May 21, 2018.

(Continued)

(51) Int. Cl.
*F01P 7/16* (2006.01)
*F01P 3/02* (2006.01)

(Continued)

(52) U.S. Cl.
CPC ..... *F01P 3/02* (2013.01); *F01M 1/08* (2013.01); *F01P 3/06* (2013.01); *F01P 7/16* (2013.01);

(Continued)

(58) Field of Classification Search
CPC ..... F01M 1/08; F01M 5/007; F01P 11/08; F01P 2003/006; F01P 3/02; F01P 3/06;

(Continued)

(56) References Cited

U.S. PATENT DOCUMENTS 1,985,240 A * 12/1934 Brubaker ..... F01P 7/165 123/41.29
2,365,166 A * 12/1944 Bay ..... F01P 11/08 123/41.33

(Continued)

FOREIGN PATENT DOCUMENTS

EP 3150821 A1 4/2017

OTHER PUBLICATIONS

International Preliminary Report on Patentability; International Searching Authority; International Application No. PCT/US2018/033673; dated Nov. 26, 2019; 8 pages.

(Continued)

*Primary Examiner* — George C Jin
*Assistant Examiner* — Teuta B Holbrook
(74) *Attorney, Agent, or Firm* — Taft Stettinius & Hollister LLP

(57) ABSTRACT

Systems, devices, and method are disclosed for differentially cooling an internal combustion engine. A cooling system includes a first cooling circuit configured to lower a temperature of a cooling fluid to a first temperature where the first cooling circuit is configured to dispense a first portion of the cooling fluid to cylinder walls and non-cylinder or non-combustion surfaces of the engine. The cooling system also includes a second cooling circuit configured to lower the temperature of a remaining or second portion of the cooling fluid to a second temperature that is lower than the first temperature where the second cooling circuit is configured to dispense the remaining portion of the cooling fluid to cylinder or combustion surfaces within one or more cylinders of the internal combustion engine.

23 Claims, 2 Drawing Sheets

Related U.S. Application Data

(60) Provisional application No. 62/509,849, filed on May 23, 2017.

(51) Int. Cl.
*F01M 1/08* (2006.01)
*F01P 3/06* (2006.01)
*F01P 11/08* (2006.01)
*F01P 3/00* (2006.01)

(52) U.S. Cl.
CPC ..... *F01P 11/08* (2013.01); *F01P 2003/006* (2013.01)

(58) Field of Classification Search
CPC ..... F01P 7/16; F01P 3/20; F01P 2003/021; F01P 2003/182; F01P 7/14; F01P 2007/146; F01P 2025/08; F02M 26/28; F02M 26/32; F02M 26/25; F02M 26/24; F02M 26/30; F02M 26/26
USPC ..... 123/41.01, 41.33, 41.44
See application file for complete search history.

(56) References Cited

U.S. PATENT DOCUMENTS 3,752,132 A 8/1973 Bentz et al.
4,348,991 A 9/1982 Stang et al.
4,369,738 A 1/1983 Hirayama
4,381,736 A 5/1983 Hirayama
4,503,679 A * 3/1985 Saito ..... F02B 39/14 184/6.11
4,708,095 A 11/1987 Luterek
5,215,044 A 6/1993 Banzhaf et al.
5,669,338 A 9/1997 Pribble et al.
6,152,088 A * 11/2000 Occella ..... F01P 7/164 123/41.01
6,182,618 B1 2/2001 Gutierrez, Jr.
6,340,006 B1 1/2002 Malatto et al.
7,261,068 B1 8/2007 Wantschik
8,464,669 B2 6/2013 Honzen et al.
8,893,669 B2 11/2014 Mehring et al.
8,997,698 B1 4/2015 Roth et al.
2009/0078220 A1 3/2009 Meyer et al.
2009/0126657 A1 5/2009 Mokire et al.
2012/0118248 A1* 5/2012 Mehring ..... F01P 3/02 123/41.08
2013/0139768 A1 6/2013 Takemoto
2015/0211399 A1* 7/2015 Knollmayr ..... F01N 3/046 60/321
2016/0123219 A1* 5/2016 Sheidler ..... F01N 3/0205 123/41.33
2016/0356256 A1* 12/2016 Tofukuji ..... F01P 7/167
2017/0306806 A1* 10/2017 Kardos ..... F01K 23/065
2018/0163607 A1* 6/2018 Uto ..... F02B 29/0443
2019/0085753 A1* 3/2019 Hara ..... F01P 7/16

OTHER PUBLICATIONS

International Search Report; International Searching Authority; International Application No. PCT/US2018/033673; dated Aug. 24, 2018; 2 pages.
Written Opinion of the International Searching Authority; International Searching Authority; International Application No. PCT/US2018/033673; dated Aug. 24, 2018; 7 pages.

* cited by examiner

ENGINE COOLING SYSTEM AND METHOD FOR A SPARK IGNITED ENGINE

CROSS-REFERENCE TO RELATED APPLICATION

The present application is a continuation of International Patent Application No. PCT/US18/33673 filed on May 21, 2018, which claims the benefit of U.S. Provisional Application No. 62/509,849 filed on May 23, 2017, which are each incorporated herein by reference.

TECHNICAL FIELD

The present disclosure relates generally to spark ignited engines, and more particularly, but not exclusively to cooling combustion surfaces of the engine differently than other engine surfaces.

BACKGROUND

In a spark ignited engine, which is typically combusting a fuel that is prone to auto-ignition or knock, combustion system surface temperatures are often a key driver for high load engine efficiency and engine load capability. A single coolant system for the engine typically provides an engine coolant at a narrowly controlled temperature range to the various surfaces of the engine to be cooled. However, some surfaces or parts of the engine function more efficiently at cooler or lower temperatures than other surfaces or parts of the engine. Therefore, the cooling of all of the engine surfaces to the narrow temperature range is problematic. Some other problems include reduced combustion phasing capabilities, a lower load capability, and/or lower engine efficiency than could be otherwise attained as some engine surfaces and parts may not be effectively cooled. Therefore, further improvements in this technology area are needed to address these issues, among others.

SUMMARY

One embodiment of the present disclosure includes a unique system, method and/or apparatus for differentially cooling an internal combustion engine. In one embodiment, the internal combustion engine includes a coolant system that includes a first cooling circuit configured to lower a temperature of a first portion of a cooling fluid to a first temperature where the first cooling circuit is configured to dispense a first portion of the cooling fluid to a non-cylinder or non-combustion surface of the engine. The coolant system also includes a second cooling circuit configured to lower the temperature of a second portion of the cooling fluid to a second temperature that is lower than the first temperature where the second cooling circuit is configured to dispense the remaining portion of the cooling fluid to a cylinder or combustion surface of the engine.

In some embodiments the first, non-cylinder cooling circuit includes one or more engine components and surfaces that are not a part of the combustion surfaces within the combustion chamber of the engine cylinders and include the cylinder wall surrounding the combustion chamber. The second, cylinder cooling circuit includes one or more cylinders, combustion surfaces within the cylinders, and/or cylinder heads (except for the internal cylinder wall) that are in fluid communication with the combustion reactions within the cylinders, such as the piston surfaces, piston rings, crank arm, etc. In one aspect, the cylinder or combustion surfaces include a cylinder head. In one aspect, each of the one or more cylinders includes a piston and a piston nozzle for outletting the second portion of the cooling fluid into the cylinder or cylinder head and/or against the combustion surfaces within the combustion chamber. It is contemplated the cooling fluid includes oil, but any suitable cooling fluid for cooling combustion surfaces of an engine is contemplated and not precluded.

In some embodiments the first cooling circuit includes a first heat exchanger. In one aspect, the first heat exchanger is an oil cooler. In some embodiments, the second cooling circuit includes a second heat exchanger. In one aspect, the second heat exchanger is an oil cooler.

In some embodiments, the first cooling circuit is connected to a first water circuit at the first heat exchanger that is configured to lower the temperature of the first portion of the cooling fluid. In one aspect, the first water circuit includes a first radiator configured to lower the temperature of the water in the first water circuit to reject the heat in the first portion of the cooling fluid. In some embodiments, the second cooling circuit is connected to a second water circuit at the second heat exchanger that is configured to lower the temperature of the remaining or second portion of the cooling fluid. In one aspect, the second water circuit includes a second radiator configured to lower the temperature of the water in the second water circuit to reject the heat in the remaining or second portion of the cooling fluid. While it is contemplated the first and second water circuits may include water as a cooling medium, other cooling mediums are also contemplated, and the use of the term "water" is not intended to be restrictive.

In one aspect, the first temperature of the first portion of the cooling fluid is between 100 degrees and 130 degrees Celsius. In other aspects, the second temperature of the remaining or second portion of the cooling fluid is between 35 degrees and 65 degrees Celsius. In one embodiment, the second temperature of the remaining or second portion of the cooling fluid is less than 80 degrees Celsius.

In other embodiments, the first cooling circuit includes a manifold configured to dispense the first portion of the cooling fluid to a non-cylinder cooling circuit and the remaining or second portion of the cooling fluid to the cylinder cooling circuit. In another embodiment, the first water circuit and the second water circuit are connected to a common radiator housing with separate radiator sections configured to differentially lower the temperature of the cooling fluid.

One embodiment of the present disclosure includes method of cooling an internal combustion engine comprising lowering a cooling fluid in a first cooling circuit to a first temperature, dispensing a first portion of the cooling fluid to a non-cylinder surface and/or a non-combustion surface of the internal combustion engine, lowering a remaining portion of the cooling fluid in a second cooling circuit to a second temperature that is lower than the first temperature, and dispensing the remaining portion of the cooling fluid onto a cylinder surface or a combustion surface of the internal combustion engine.

In one aspect, the non-cylinder or non-combustion surfaces include one or more engine components that are not located within a cylinder of the internal combustion engine.

In another aspect, the cylinder or combustion surfaces include internal surfaces within one or more cylinders of the internal combustion engine that are not a wall of the cylinder.

In one aspect, the cylinder or combustion surfaces include a piston within the one or more cylinders.

This summary is not intended to identify key or essential features of the claimed subject matter, nor is it intended to be used as an aid in limiting the scope of the claimed subject matter. Further embodiments, forms, objects, features, advantages, aspects, and benefits shall become apparent from the following description and drawings.

BRIEF DESCRIPTION OF THE DRAWINGS

The description herein makes reference to the accompanying drawings wherein like numerals refer to like parts throughout the several views, and wherein.

DESCRIPTION OF THE ILLUSTRATED EMBODIMENTS

Figure 1:
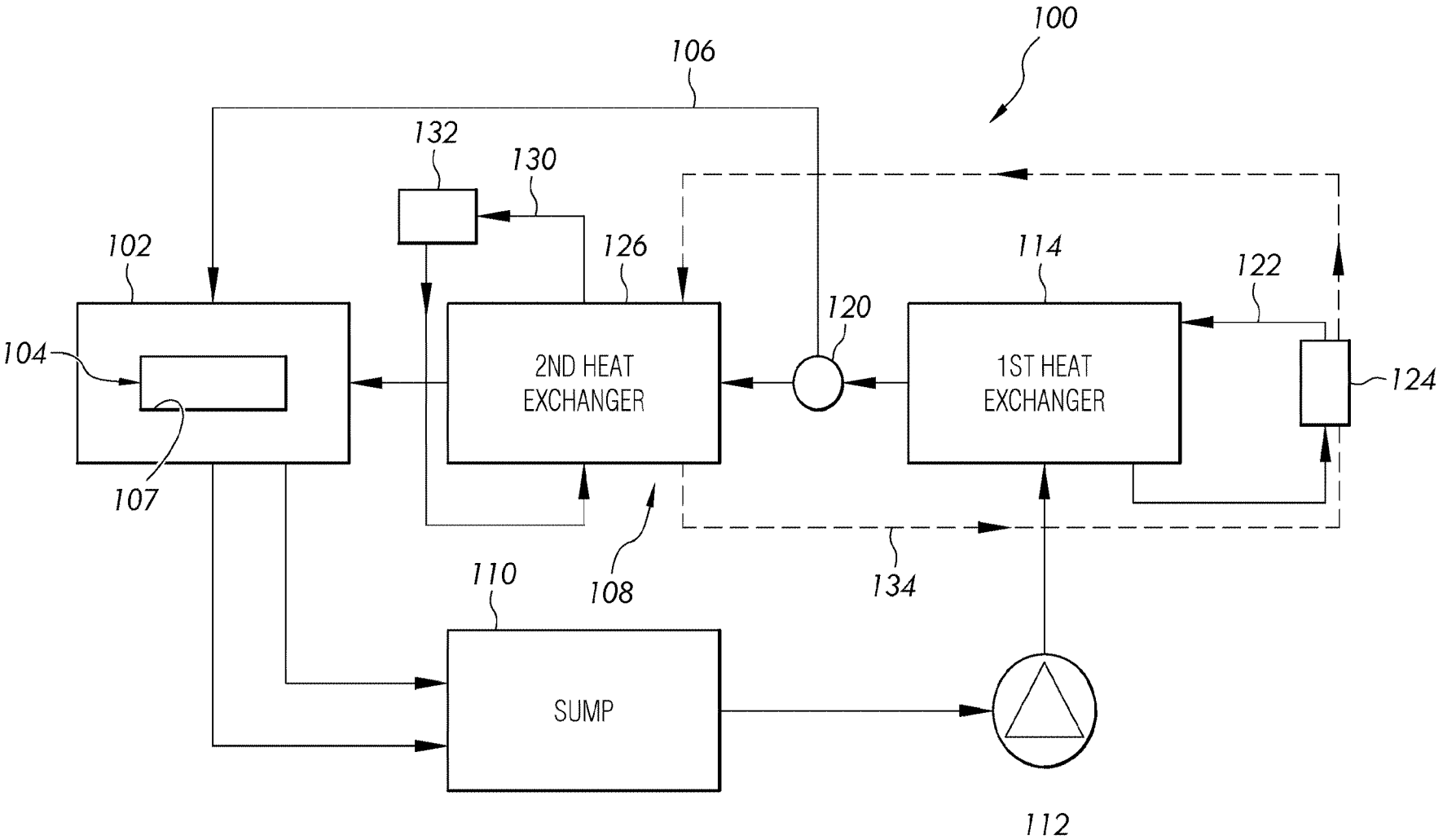
FIG. 1 is a schematic illustration of a cooling system for an internal combustion engine.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

Figure 2:
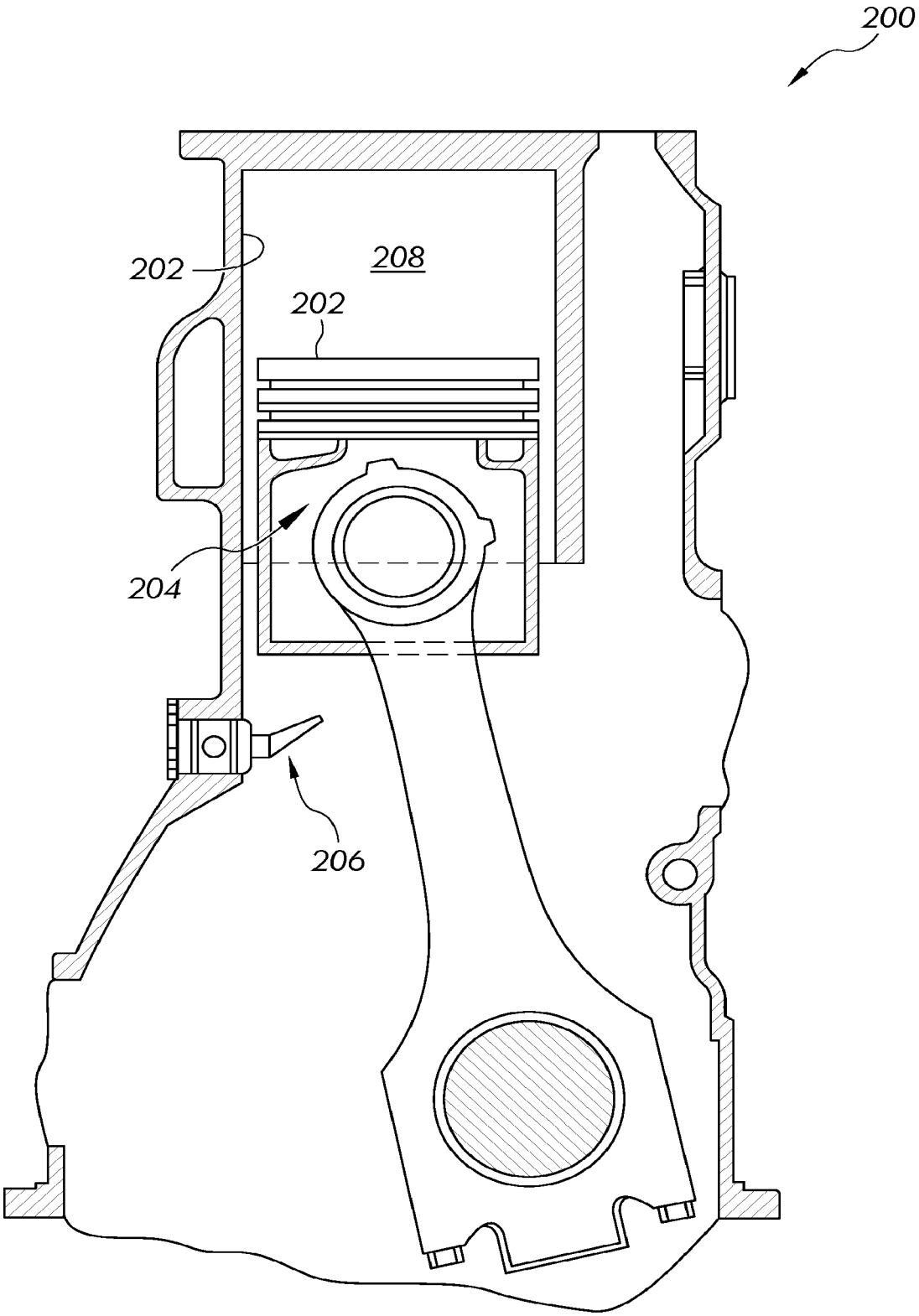
FIG. 2 is a schematic cross-sectional view of a cylinder of the internal combustion engine.

FIG. 1 illustrates one embodiment of a cooling system 100 of an internal combustion engine 102 that includes one or more cylinders 104 that includes one or more combustion surfaces 107 that are in direct communication with the combustion of the air-fuel mixture in the corresponding cylinder 104. Cooling system 100 includes a first or non-cylinder cooling circuit 106 and a second or cylinder cooling circuit 108 connected to one or more cylinders 104 or combustion surfaces 107 or cylinder heads through which a cooling fluid passes (not illustrated). The non-cylinder cooling circuit 106 includes one or more engine components that are not a cylinder and/or not a combustion surface except for the walls of the cylinders. Some examples of engine components that are not a cylinder include an engine block, engine bearings, a turbocharger, the cylinder walls, and an exhaust gas recirculation (EGR) system, for example. The cylinder cooling circuit 108 includes one or more cylinders 104 such as cylinder 200 as illustrated in FIG. 2 and described in more detail below.

The cooling fluid can be any type of fluid which is suitable for the internal combustion engine, such as oil or other lubricants. The cooling system 100 also includes first cooling circuit 106 and second cooling circuit 108 fluidly coupled to a sump 110 downstream of engine 102 and cylinders 104. The sump 110 is configured to receive and collect the cooling fluid as a reservoir. The cooling system 100 also includes a pump 112 downstream of and fluidly connected to the sump 110 wherein the pump 112 is configured to convey the combined cooling fluid from the first and second cooling circuits 106, 108 to a first heat exchanger 114.

The first heat exchanger 114 is configured to receive the cooling fluid from pump 112 at an initial temperature and cool the cooling fluid to a first temperature that is cooler or lower than the initial temperature by heat dissipation. In one embodiment, the first temperature of the cooling fluid is between 100 degrees and 130 degrees Celsius. In some embodiments, the first heat exchanger 114 is an oil cooler. In the illustrated embodiment, the first heat exchanger 114 is connected to a first water circuit 122. The first water circuit 122 includes water (which may also include or alternatively be anti-freeze or other suitable coolant liquid) which passes through the first heat exchanger 114 and exchanges heat from the cooling fluid to cool the cooling fluid. The first water circuit 122 includes a first radiator 124 that exchanges the heat in the water circuit with the surrounding air to lower the temperature of the water or cooling liquid in the first water circuit 122. In some forms, the first water circuit 122 includes a water pump (not illustrated) to convey or pump water through the first radiator 124 for additional heat dissipation. Alternatively, the first radiator 124 can be configured to receive water or cooling liquid from the first water circuit 122 and additional water or cooling liquid from the second cooling circuit 108 as described below.

The first or non-cylinder cooling circuit 106 may also include a manifold 120 that is configured to divide the cooling fluid into a first portion and a second or remaining portion. The manifold 120 also routes or directs the first portion of the cooling fluid at the first temperature to the non-cylinder cooling circuit 106 and routes or directs the remaining portion of the cooling fluid at the first temperature to the second cooling circuit 108. The first portion of the cooling fluid is supplied to the non-cylinder cooling circuit 106 to cool the non-cylinder engine components 102, which can include the cylinder walls.

The second or cylinder cooling circuit 108 is fluidly coupled to the manifold 120 and is configured to receive the remaining portion of the cooling fluid from the manifold 120 at the first temperature. The second cooling circuit 108 cools or lowers the temperature of the remaining portion of the cooling fluid to a second temperature that is lower than the first temperature via a second heat exchanger 126. In one embodiment, the second temperature of the remaining portion of the cooling fluid is between 35 degrees and 65 degrees Celsius. In another embodiment, the second temperature of the remaining portion of the cooling fluid is less than 80 degrees Celsius.

The second cooling circuit 108 includes second heat exchanger 126 that is fluidly coupled to the manifold 120 and in series with the first heat exchanger 114 to receive the remaining portion of the cooling fluid and cool the cooling fluid to the second temperature. In some embodiments, the second heat exchanger 126 is an oil cooler. In some embodiments, the second heat exchanger 126 is fluidly coupled to a second water circuit 130 that is configured to lower the temperature of the remaining portion of the cooling fluid. The second water circuit 130 includes a second radiator 132 and water or other suitable coolant liquid that is circulated through second heat exchanger 126 and second radiator 132 for heat dissipation from the cooling fluid that is at the first temperature. In other embodiments, the second water circuit 130 is fluidly connected to the first radiator 124 by a branch circuit 134 such that the remaining portion of the cooling fluid flows to a second or additional section of the first radiator 124 for additional cooling. In this form, the first radiator 124 is bifurcated such that the water or coolant liquid in the second water circuit 134 is kept separate and distinct from the water or coolant liquid in the first water circuit 122.

As mentioned previously, the cylinders 104 include one or more cylinders such as cylinder 200 as illustrated in FIG. 2. It should be appreciated that cylinder 200 is for illustrative purposes and that other forms of cylinders are within the scope of this application. Cylinder 200 includes one or more combustion surfaces 202 that are located within combustion chamber 208, such as a piston 204 and crank arm. Cylinder 200 also includes a cylinder head. Cylinder 200 includes a piston nozzle 206 that is configured to spray the remaining or second portion of cooling fluid from the second cooling circuit 108 onto the combustion surfaces 202 to cool the combustion surfaces 202 to the second temperature, which is lower than the first temperature.

As the first portion of cooling fluid passes through the first cooling circuit 106 and the remaining portion of cooling fluid passes through the second cooling circuit 108, the cooling fluid undergoes a change in temperature (the cooling fluid absorbs heat and thus cools the non-cylinder engine components 102 and the cylinder or combustion surfaces 104/107. Thereafter the first portion of cooling fluid and the remaining portion of cooling fluid pass to the sump 110 for distribution by the pump 112 through the first and second heat exchangers 114, 126 and through the first cooling circuit 106 and the second cooling circuit 108 to repeat the cooling cycle again.

The cooling system 100 is not limited to the illustrated components. Additional heat exchangers, oil coolers, radiators, pumps, temperature sensors, pressure sensors, etc., can be integrated with the cooling system 100, the first cooling circuit 106, and/or the second cooling circuit 108.

While the invention has been illustrated and described in detail in the drawings and foregoing description, the same is to be considered as illustrative and not restrictive in character, it being understood that only certain exemplary embodiments have been shown and described and that all changes and modifications that come within the spirit of the inventions are desired to be protected. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

The invention claimed is:

1. A coolant system for an internal combustion engine, the system comprising:

a first cooling circuit configured to lower a temperature of a cooling fluid to a first temperature, the first cooling circuit is configured to dispense a first portion of the cooling fluid to a non-cylinder surface and/or a non-combustion surface of the internal combustion engine; and a second cooling circuit configured to lower the temperature of a remaining portion of the cooling fluid from the first cooling circuit to a second temperature that is lower than the first temperature, the second cooling circuit is configured to dispense the remaining portion of the cooling fluid onto a cylinder surface or a combustion surface of the internal combustion engine.

2. The coolant system of claim 1, wherein the non-cylinder or non-combustion surfaces include one or more engine components that are not located within a cylinder of the internal combustion engine.

3. The coolant system of claim 1, wherein the cylinder or combustion surfaces include internal surfaces within one or more cylinders of the internal combustion engine that are not a wall of the cylinder.

4. The coolant system of claim 3, wherein the cylinder or combustion surfaces include a piston within the one or more cylinders.

5. The coolant system of claim 3, wherein the cylinder or combustion surfaces include a cylinder head.

6. The coolant system of claim 1, wherein the cooling fluid includes oil.

7. The coolant system of claim 1, wherein the first cooling circuit includes a first heat exchanger.

8. The coolant system of claim 7, wherein the first heat exchanger is an oil cooler.

9. The coolant system of claim 7, wherein the second cooling circuit includes a second heat exchanger.

10. The coolant system of claim 9, wherein the second heat exchanger is an oil cooler.

11. The coolant system of claim 1, wherein the first cooling circuit is connected to a first water circuit configured to lower the temperature of the cooling fluid.

12. The coolant system of claim 11, wherein the first water circuit includes a first radiator configured to lower the temperature of the fluid in the first water circuit and reject the heat from the first portion of the cooling fluid.

13. The coolant system of claim 1, wherein the second cooling circuit is connected to a second water circuit configured to lower the temperature of the remaining portion of the cooling fluid.

14. The coolant system of claim 13, wherein the second water circuit includes a second radiator configured to lower the temperature of the fluid in the second water circuit and reject the heat from the remaining portion of the cooling fluid.

15. The coolant system of claim 1, wherein the first temperature of the cooling fluid is between 100 degrees and 130 degrees Celsius.

16. The coolant system of claim 1, wherein the second temperature of the remaining portion of the cooling fluid is between 35 degrees and 65 degrees Celsius.

17. The coolant system of claim 1, wherein the second temperature of the remaining portion of the cooling fluid is less than 80 degrees Celsius.

18. The coolant system of claim 1, wherein the first cooling circuit includes a manifold configured to dispense the first portion of the cooling fluid to the non-cylinder or non-combustion surfaces and the remaining portion of the cooling fluid to the second cooling circuit.

19. The coolant system of claim 1, wherein the first cooling circuit and the second cooling circuit are connected to a common radiator housing with radiator sections configured to differentially lower the temperature of the cooling fluid.

20. A method of cooling an internal combustion engine, the method comprising:

lowering a cooling fluid in a first cooling circuit to a first temperature;

dispensing a first portion of the cooling fluid to a non-cylinder surface and/or a non-combustion surface of the internal combustion engine;

lowering a remaining portion of the cooling fluid from the first cooling circuit in a second cooling circuit to a second temperature that is lower than the first temperature; and dispensing the remaining portion of the cooling fluid onto a cylinder surface or a combustion surface of the internal combustion engine.

21. The method of claim 20, wherein the non-cylinder or non-combustion surfaces include one or more engine components that are not located within a cylinder of the internal combustion engine.

22. The method of claim 20, wherein the cylinder or combustion surfaces include internal surfaces within one or more cylinders of the internal combustion engine that are not a wall of the cylinder.

23. The method of claim 20, wherein the cylinder or combustion surfaces include a piston within the one or more cylinders.

* * * * *